US007490956B2

(12) United States Patent
Hough

(10) Patent No.: US 7,490,956 B2
(45) Date of Patent: Feb. 17, 2009

(54) ILLUMINATION SYSTEM

(75) Inventor: Thomas A. Hough, Tucson, AZ (US)

(73) Assignee: Whiterock Design, LLC, Tucson, AZ (US)

( * ) Notice: Subject to any disclaimer, the term of this patent is extended or adjusted under 35 U.S.C. 154(b) by 61 days.

(21) Appl. No.: 11/185,166

(22) Filed: Jul. 20, 2005

(65) Prior Publication Data

US 2006/0007688 A1 Jan. 12, 2006

Related U.S. Application Data

(60) Provisional application No. 60/591,315, filed on Jul. 27, 2004, provisional application No. 60/592,073, filed on Jul. 29, 2004.

(51) Int. Cl.
*F21V 7/00* (2006.01)

(52) U.S. Cl. ..... 362/247

(58) Field of Classification Search ..... 362/247
See application file for complete search history.

(56) References Cited

U.S. PATENT DOCUMENTS

| | | | | | |
|---|---|---|---|---|---|
| 3,492,474 | A | * | 1/1970 | Hishinuma et al. | 362/350 |
| 4,242,727 | A | | 12/1980 | deVos et al. | |
| 4,545,000 | A | * | 10/1985 | Fraley et al. | 362/304 |
| 4,575,788 | A | | 3/1986 | Lewin | |
| 4,617,619 | A | | 10/1986 | Gehly | |
| 4,683,525 | A | | 7/1987 | Camm | |
| 4,855,886 | A | | 8/1989 | Eijkelenboom et al. | |
| 4,985,814 | A | | 1/1991 | Lyons | |
| 4,994,948 | A | | 2/1991 | Cooch | |
| 5,008,781 | A | | 4/1991 | Nino | |
| 5,192,962 | A | * | 3/1993 | Nishida et al. | 353/98 |
| 5,268,613 | A | * | 12/1993 | Cunningham | 313/113 |
| D351,251 | S | | 10/1994 | Schreder | |
| 5,446,637 | A | | 8/1995 | Cunningham et al. | |
| 5,562,342 | A | | 10/1996 | Nino | |
| 5,607,229 | A | | 3/1997 | Rykowski et al. | |
| RE36,316 | E | * | 9/1999 | Cunningham | 313/113 |
| 5,951,139 | A | | 9/1999 | Smith et al. | |
| 6,034,473 | A | * | 3/2000 | McBride et al. | 313/578 |
| 6,122,440 | A | | 9/2000 | Campbell | |

(Continued)

FOREIGN PATENT DOCUMENTS

| | | |
|---|---|---|
| DE | 12 27 404 B | 10/1966 |

(Continued)

OTHER PUBLICATIONS

William B. Elmer, The Optical Design of Reflectors, John Wiley and Sons, New York, NY, 1980, pp. 162, 172 (ISBN 0-471-05310-4).

*Primary Examiner*—Sandra O'Shea
*Assistant Examiner*—James W Cranson

(57) ABSTRACT

An illumination system, reflector and method for producing a beam with a substantially circularly symmetric irradiance distribution from a light source having a plurality of linear light emitting elements arranged with their longitudinal axes substantially parallel with each other and spaced substantially symmetrically about a central longitudinal axis. The reflector includes a plurality of reflecting zones corresponding to, and aligned with, the plurality of light emitting elements. A surface of a reflecting zone may be defined by rotating a generator curve around an axis of rotation that is not coaxial with the longitudinal axis of the light source.

20 Claims, 8 Drawing Sheets

U.S. PATENT DOCUMENTS 6,447,147 B1 9/2002 Kramer et al.
6,467,934 B1 10/2002 Holten et al.
6,525,452 B1 2/2003 Guinard
6,621,214 B1 9/2003 Schloemer et al.
6,633,112 B2 10/2003 Davies et al.
6,783,263 B1 8/2004 Cronk
6,793,375 B2 9/2004 Anderson
6,796,682 B2 * 9/2004 Hough et al. ..... 362/268
6,840,654 B2 1/2005 Guerrieri et al.
7,048,412 B2 * 5/2006 Martin et al. ..... 362/247
2002/0181231 A1 * 12/2002 Luk ..... 362/240
2003/0206414 A1 * 11/2003 Wood et al. ..... 362/293
2005/0036332 A1 * 2/2005 Steinhart et al. ..... 362/516

FOREIGN PATENT DOCUMENTS

EP 1 371 901 A2 12/2003
EP 1371901 A2 * 12/2003

* cited by examiner

ILLUMINATION SYSTEM

CROSS-REFERENCE TO RELATED APPLICATIONS

This application claims the benefit of U.S. Provisional Application No. 60/591,315, filed Jul. 27, 2004, and U.S. Provisional Application No. 60/592,073, filed Jul. 29, 2004.

TECHNICAL FIELD OF THE INVENTION

The present invention relates to illumination systems and, more particularly, to an illumination system that produces a beam of light having a substantially circularly symmetric irradiance distribution from a lamp having a plurality of linear light emitting elements.

BACKGROUND OF THE INVENTION

The Ellipsoidal Reflector Spotlight (ERS) and the Parabolic Wash light (PAR) are two of the most popular lighting fixtures used in theatre, television, and architectural lighting. Certain ERS and PAR lighting fixtures employ an incandescent High Performance Lamp (HPL) that includes a plurality of linear, helically-wound filaments arranged with their longitudinal axes substantially parallel with each other and arranged with their longitudinal axes spaced substantially symmetrically about a central longitudinal axis. Such ERS and PAR lighting fixtures typically have a reflector to collect the light from the lamp and direct it forward out of the fixture.

When an HPL lamp is used with a reflector having a circularly symmetric cross section, the irradiance distribution of the forwardly directed beam is not circularly symmetric. Rather, the irradiance distribution is characterized by a number of "hot spots" surrounding a central minimum, or void. The number of hot spots is equal in number to the number of helically wound filaments contained in the HPL lamp. The central minimum is due to the fact that no light emitting element is located along the lamp's central longitudinal axis.

FIGS. 1A, 1B and 1C show an HPL lamp 100 with four helically-wound filaments 102, 104, 106 and 108 arranged with their longitudinal axes substantially parallel with each other and with their longitudinal axes spaced substantially symmetrically about a central longitudinal axis 105. The lamp includes a base 110, a transparent enclosure 112, and a pair of insulating filament support structures 116. FIG. 1C shows an electrical conductor 117 connecting the filaments so that they operate electrically in series.

The four emitting filament sections 102, 104, 106 and 108 are composed of tightly wound helical coils, each of which emits light and in certain directions, block the light emitted from other filaments, creating shadows. These shadows are visible in the lamp's intensity distribution. Intensity is defined as the lumens or power directed into a given solid angle. The filament shadows create inconsistencies in a beam of light formed by collecting the light from the lamp and directing it forward with a typical prior art reflector.

FIG. 2 illustrates an intensity distribution graph 200, measured in a plane that is perpendicular to the HPL lamp's central longitudinal axis. The intensity data in the graph are generated in the following manner. The HPL lamp is burned base downward in a vertical orientation, while an intensity meter is moved in a circle centered on the lamp's central longitudinal axis. At each angle around the circle, the intensity is noted. Plotting the intensity versus angular position on a set of polar axes produces the intensity distribution graph 200. A number of filament shadows 202, 204, 206, 208, 210, 212, 214 and 216 are present in the beam. For clarity, the positions of the HPL filaments 102, 104, 106 and 108 are superimposed on the graph.

Prior art Ellipsoidal Reflector Spotlight (ERS) optical systems that employ the HPL lamp also employ a reflector generated from an ellipsoidal or near-ellipsoidal curve, typically referred to as an ellipsoidal reflector. A generator curve is rotated about the lamp's central longitudinal axis to form a reflecting surface. FIG. 3 shows an ellipsoidal or near-ellipsoidal generator curve 302, an HPL lamp 100 and its central longitudinal axis 105, and an optical axis 304 of the ERS system, which is coincident with the lamp's central longitudinal axis 105. A dotted curve 308 depicts the opening of the reflecting surface, and a circular arrow 310 depicts the sense of rotation as the generator curve 302 is swept around the optical axis 304 of the ERS system.

FIG. 4 shows an orthogonal view of a reflecting surface 400 resulting from application of the prior art method described with regard to FIG. 3. The reflecting surface 400 has a smooth bowl-like shape. Since the generator curve 302 was rotated about the optical axis 304 of the ERS system, a cross section 402 taken through the reflecting surface 400, in a plane perpendicular to the optical axis 304 of the ERS system, is a circle.

As described with regard to FIG. 2, the light emitting filaments in the HPL lamp shadow each other. When a smooth reflector is employed in the ERS optical system, the filament shadows tend to be visible in the forward propagating beam projected by the reflector. For this reason, prior art ERS reflectors for use with HPL lamps often employ facets or lunes on their surface in an attempt to produce a circularly symmetric irradiance distribution, free from filament shadows and hot spots.

Facets are small planar segments, which are tiled over the reflector's surface. Lunes are ribbon-like segments, which have curvature in one direction only, and are also tiled over the reflector's surface. The facets or lunes are perturbations of the smooth reflecting surface profile, and therefore help to smooth or homogenize the beam formed by the lamp and reflector. FIG. 5A shows a reflector section 502 that has been covered with facets 504. FIG. 5B shows a reflector section 506 that has been covered with lunes 508.

A reflective surface formed according to the prior art method described with regard to FIG. 3 and faceted or luned according to the methods described with regard to FIG. 5 has a generally circular cross section 402. But the cross section 402 is actually a polygon whose number of sides is equal to the number of facets or lunes through the cross section of the reflective surface 400.

A small number of large facets or lunes tend to smooth the irradiance distribution in the projected beam by filling in the filament shadows present in the lamp's intensity distribution. However, large facets or lunes also cause a significant deviation from the reflector's original shape, resulting in a decrease in the efficiency of the optical system. The efficiency of an optical system is defined as the ratio of the power in the projected beam to the power of the lamp. To preserve efficiency, and minimize the deviation from the reflector's original shape, the size and number of facets or lunes are often varied across the reflector's surface. Such an arrangement smoothes the irradiance distribution of the projected beam, while minimizing the impact on the optical system efficiency. FIGS. 6A and 6B show orthogonal and front views, respectively, of a prior art ERS reflector 600 whose surface is covered with lunes of differing sizes and numbers in regions 602, 604 and 606.

FIG. 7 presents a schematic view of a prior art ERS projection optics system 700. The ERS optical system 700 includes an HPL lamp 100, a luned ellipsoidal reflector 600, a projection gate 702, and a projection lens 704. The projection lens 704 forms an image 706 of the projection gate, or any object placed therein, on a distant projection surface 708. Objects placed in the projection gate may be referred to as gobos. Since the projection lens 704 forms an image of the projection gate 702, the radiometric characteristics of the beam at the gate location are conveyed to the image 706 formed on the projection surface 708. Therefore, if the beam in the projection gate does not have a desired irradiance distribution, the image projected on the distant surface will not have the desired irradiance distribution.

FIG. 8 presents a contour map 800 of the irradiance distribution of the beam formed by the ERS optical system 700 on the distant projection surface 708. As described with regard to FIG. 7, this irradiance distribution is also descriptive of the irradiance distribution of the beam at the projection gate 702. Each contour 802 on the contour map 800 defines a zone of constant irradiance, or an isoirradiance contour. Although the ERS reflector surface is luned, the beam at the projection gate does not have a uniform irradiance distribution.

As the isoirradiance contours in FIG. 8 show, the irradiance distribution is not circularly symmetric. The irradiance distribution has a minimum, or void, at the center 804, which is due to the fact that no emitter is located on the central longitudinal axis of the HPL lamp. Furthermore, the irradiance distribution has four hot spots 806, 808, 810 and 812, which coincide with the location of the four emitting filaments in the HPL lamp.

Thus, the irradiance distribution map 800 is rotationally symmetric, that is, if rotated by some multiple of ninety degrees the resulting map is substantially identical to the original map. However, the map is not circularly symmetric. If rotated by an arbitrary number of degrees (specifically an angle other than a multiple of ninety degrees) the rotated map is not substantially identical to the original map.

A Parabolic Wash light (PAR) may also employ the HPL lamp. In a PAR optical system, a parabolic or near-parabolic curve is rotated about the longitudinal axis of the optical system to form a reflecting surface, typically referred to as a parabolic reflector. Because the generator curve is parabolic or near-parabolic, a beam exiting the reflector is substantially parallel to the optical axis of the PAR system. That is, the light beam is made up of light rays that are substantially parallel to each other and to the optical axis.

A PAR optical system typically consists solely of a reflector and lamp, although a lens may be placed after the reflector to further smooth or shape the beam. As described with regard to an ERS optical system, a parabolic reflector surface in a PAR optical system may be covered with facets or lunes in an attempt to project a beam with a smooth irradiance distribution. However, the irradiance distribution of a beam produced by such a PAR optical system has a central void and four hot spots, as described with regard to an ERS optical system.

SUMMARY OF THE INVENTION

The present invention provides a reflector for use with a light source having a plurality of linear light emitting elements arranged with their longitudinal axes substantially parallel with each other and spaced substantially symmetrically about a central longitudinal axis. The reflector and light source form an efficient optical system that produces a beam with a substantially circularly symmetric irradiance distribution that is substantially without hot spots or voids.

More specifically, aspects of the invention may be found in an illumination system having a light source with a plurality of linear light emitting elements and a concave reflector with a corresponding plurality of reflecting zones. The light emitting elements are arranged symmetrically around a longitudinal axis of the light source and the longitudinal axes of the light emitting elements are parallel to each other. The reflecting zones are aligned with the plurality of light emitting elements. The illumination system produces a light beam having a substantially circularly symmetric irradiance distribution.

Other aspects of the invention may be found in a concave reflector for use with a light source having a plurality of linear light emitting elements arranged with their longitudinal axes substantially parallel with each other and spaced substantially symmetrically about a central longitudinal axis. The reflector includes a plurality of reflecting zones corresponding to, and aligned with, the plurality of light emitting elements. The reflector produces a light beam having a substantially circularly symmetric irradiance distribution.

A surface of a reflecting zone may be defined by rotating a generator curve around an axis of rotation that is not coaxial with the longitudinal axis of the light source.

Further aspects of the invention may be found in a method for producing a light beam having a substantially circularly symmetric irradiance distribution from a light source having a plurality of linear light emitting elements arranged with their longitudinal axes substantially parallel with each other and spaced substantially symmetrically about a central longitudinal axis. Steps of the method include forming a concave reflector having a plurality of reflecting zones corresponding to the plurality of light emitting elements, and installing the light source coaxially in the reflector so that the light emitting elements are aligned with the reflecting zones.

The step of forming the concave reflector may include the step of defining a surface of a reflecting zone by rotating a generator curve around an axis of rotation that is not coaxial with the longitudinal axis of the light source.

As such, a concave reflector, illumination system and method for producing a light beam having a substantially circularly symmetric irradiance distribution from a light source having a plurality of linear light emitting elements arranged with their longitudinal axes substantially parallel with each other and spaced substantially symmetrically about a central longitudinal axis is described. Other aspects, advantages and novel features of the present invention will become apparent from the detailed description of the invention and claims, when considered in conjunction with the accompanying drawings.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE PREFERRED EMBODIMENT

A preferred embodiment of the present invention is a reflector having a non-circular cross section in a plane perpendicular to the reflector's central longitudinal axis. The reflector includes reflecting zones equal in number to, and rotationally aligned with, the light emitting elements of a prior art High Performance Lamp (HPL).

Figure 1A:
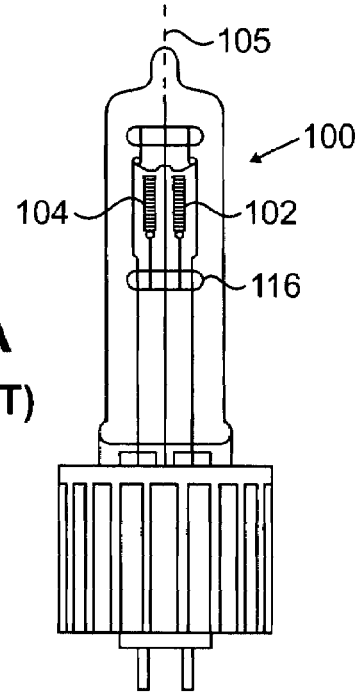
FIG. 1A (PRIOR ART)
FIGS. 1A, 1B and 1C depict top, side and front views, respectively, of a prior art lamp employing four (4) parallel filaments.
Figure 1B:
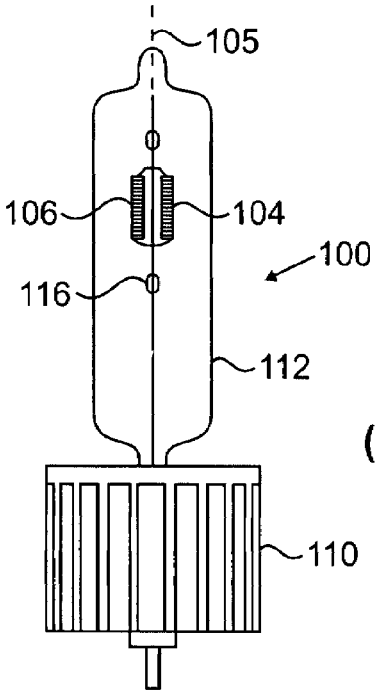
FIG. 1B (PRIOR ART)
Figure 1C:
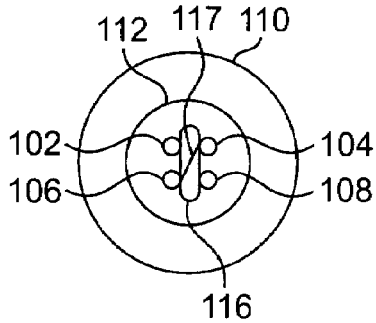
FIG. 1C (PRIOR ART)
Figure 2:
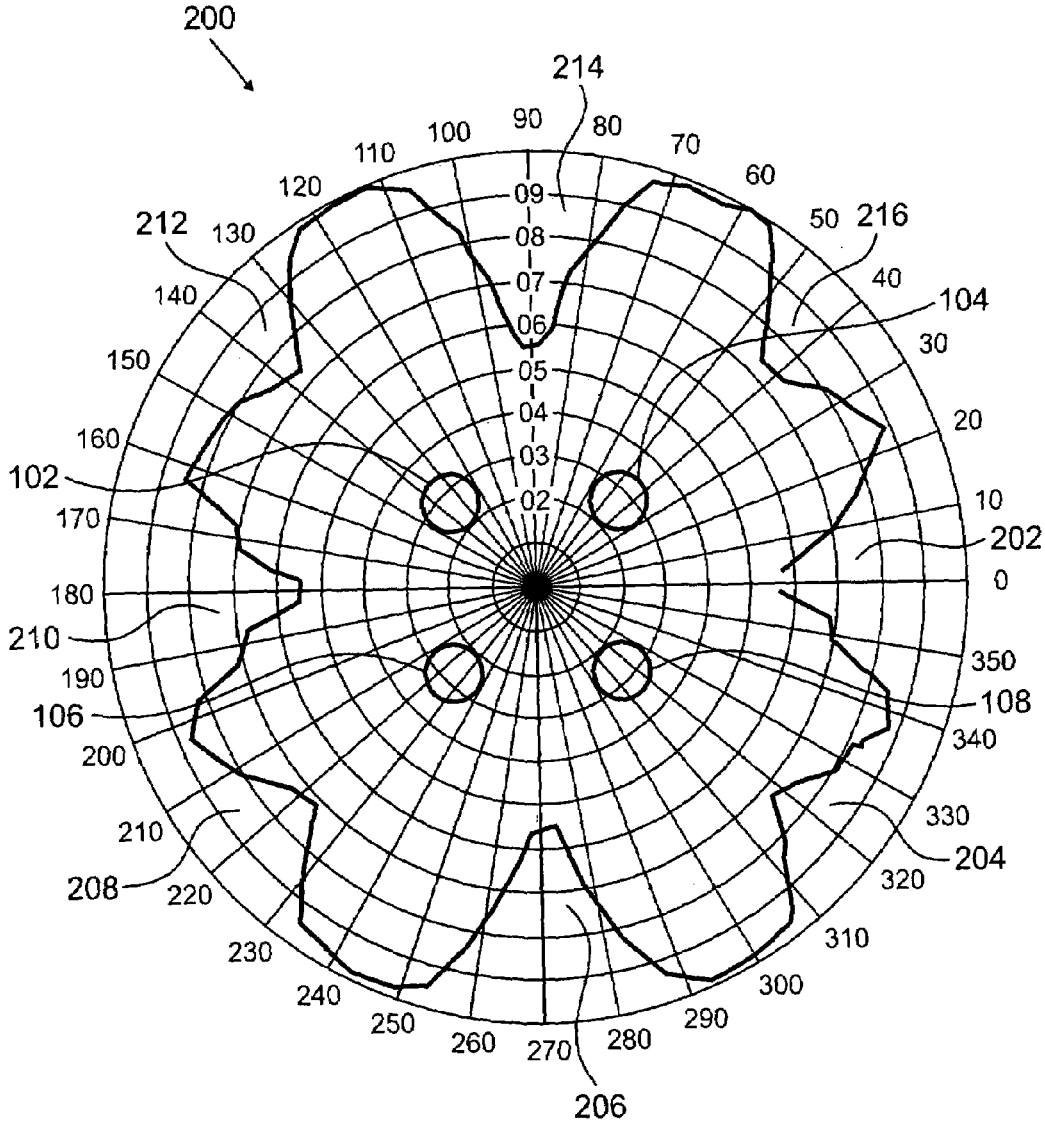
FIG. 2 (PRIOR ART)
FIG. 2 illustrates an intensity distribution chart for the lamp of FIG. 1.
Figure 3:
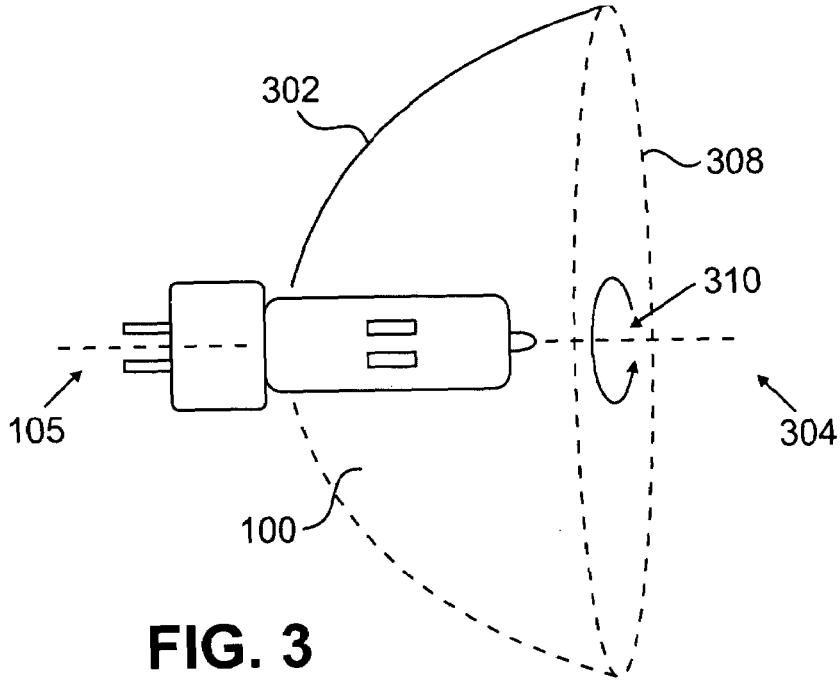
FIG. 3 (PRIOR ART)
FIG. 3 schematically depicts a prior art ellipsoidal reflector for use with the lamp of FIG. 1.
Figure 4:
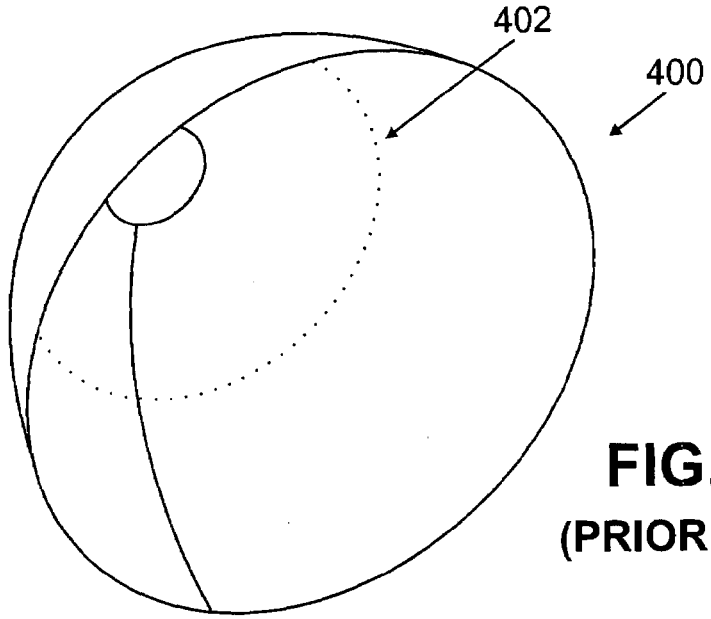
FIG. 4 (PRIOR ART)
FIG. 4 is an orthogonal view of the prior art reflector depicted in FIG. 3.
Figure 5A:
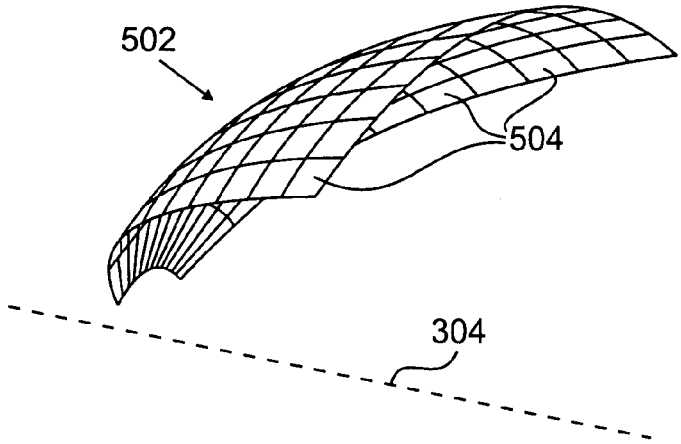
FIG. 5A (PRIOR ART)
FIG. 5A shows a section of a prior art reflector formed with facets on its surface.
Figure 5B:
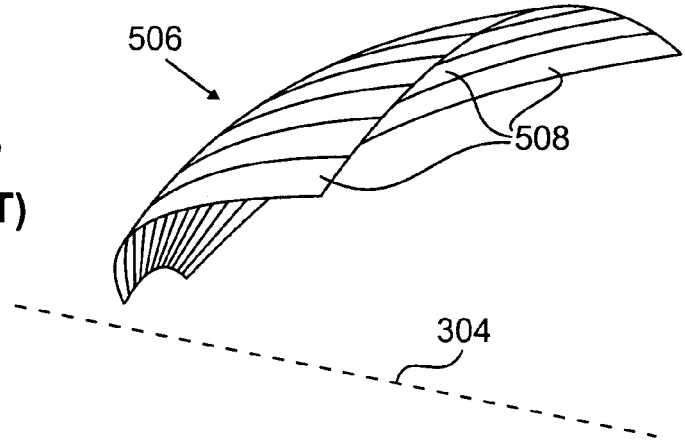
FIG. 5B (PRIOR ART)
FIG. 5B shows a section of a prior art reflector formed with lunes on its surface.
Figure 6A:
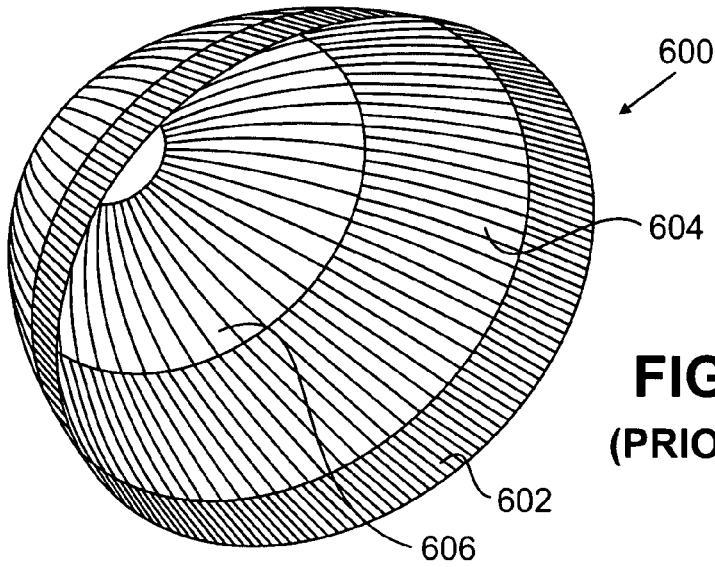
FIG. 6A (PRIOR ART)
FIGS. 6A and 6B are orthogonal and front views, respectively, of a prior art reflector formed with lunes on its surface.
Figure 6B:
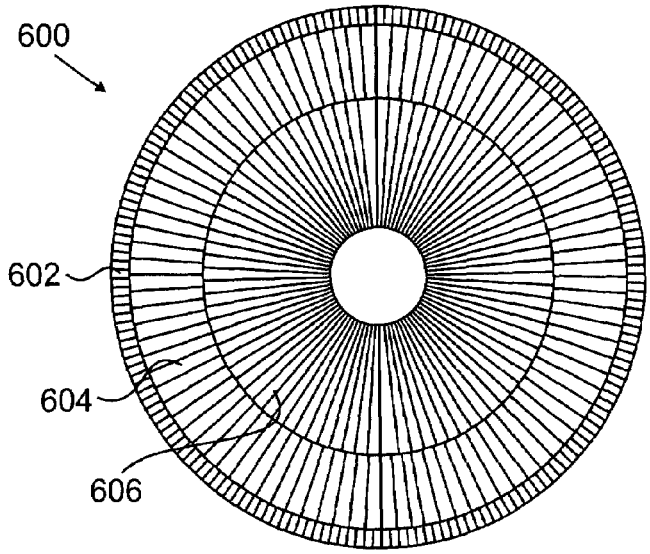
FIG. 6B (PRIOR ART)
Figure 7:
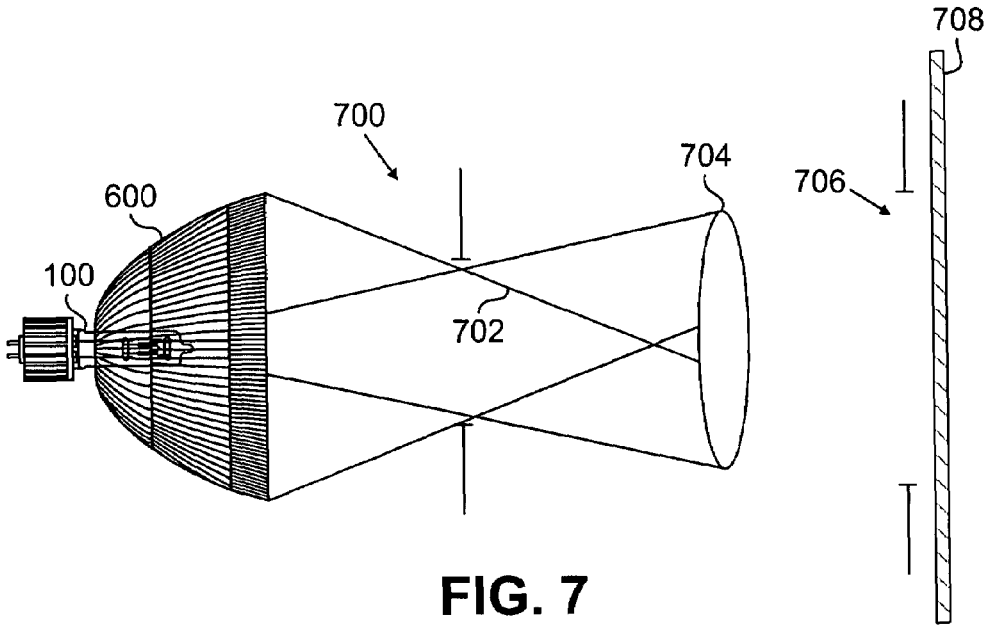
FIG. 7 (PRIOR ART)
FIG. 7 presents a schematic view of a prior art ellipsoidal reflector spotlight (ERS) projection optical system employing the lamp of FIG. 1.
Figure 8:
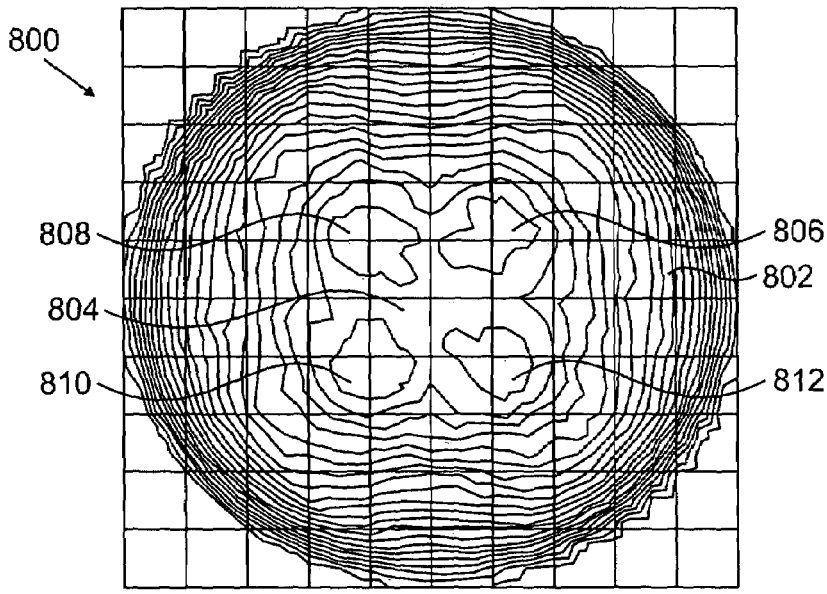
FIG. 8 (PRIOR ART)
FIG. 8 illustrates an irradiance distribution chart for the ERS projection optics system shown in FIG. 7.
Figure 9:
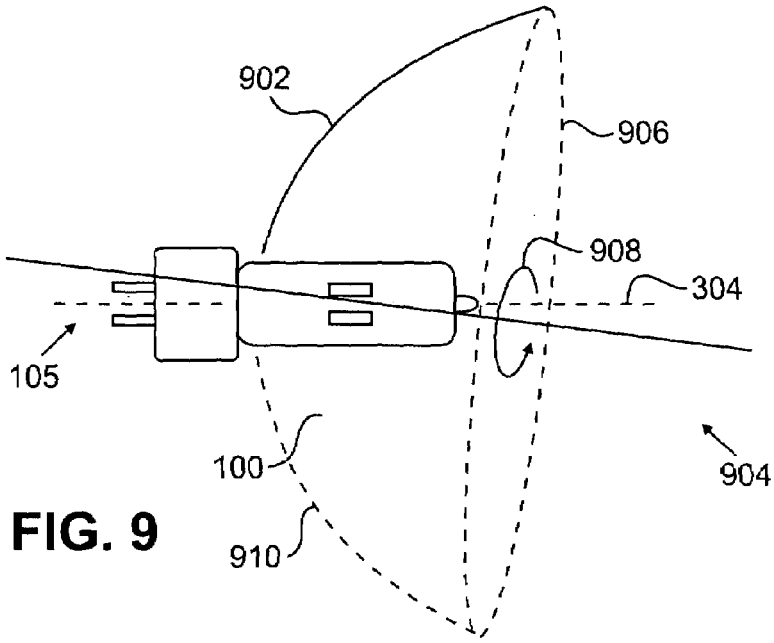
FIG. 9 is a schematic view of an exemplary construction technique for generating a reflecting zone for a reflector according to the present invention.

FIG. 9 depicts a schematic view of an exemplary construction technique for generating a reflecting zone for a reflector according to the present invention. FIG. 9 shows a generator curve 902, an HPL lamp 100 and its central longitudinal axis 105, and an optical axis 304, which is defined by the lamp's longitudinal axis 105. An axis of rotation 904, which is not coaxial with the lamp's longitudinal axis 105, is also shown. The axis of rotation 904 may intersect the lamp's longitudinal axis 105, and the optical axis 304, as shown, or may lie parallel to it. Axis of rotation 904 is shown at an angle that brings the forward tip of generator curve 902 closer to the optical axis 304, but it may alternatively be defined at an angle that moves the forward tip of generator curve 902 farther away from the optical axis 304.

The location and orientation of the axis of rotation 904 is determined through an iterative optimization procedure. The optimization procedure seeks an axis of rotation that maximizes the circular symmetry of the resulting irradiance distribution, minimizes hot spots and voids in the irradiance distribution, and maximizes the resulting optical system efficiency A reflecting surface is defined by rotating the generator curve 902 about the axis of rotation 904. Arrow 908 depicts the sense of rotation during the construction process. A dotted curve 906 represents an opening of the reflecting surface, and dotted curve 910, in combination with the generator curve 902, depicts a cross section of the reflecting surface.

The generator curve 902, as shown, is an arbitrary curve. Alternatively, the generator curve used could be a segment of an elliptical, parabolic or hyperbolic curve or any other curve described by a polynomial or other mathematical function. As is well known in the art, a conventional reflector defined by an ellipsoidal or near-ellipsoidal curve will produce a converging light beam, a conventional reflector defined by a parabolic or near-parabolic curve will produce a substantially parallel light beam, and a conventional reflector defined by a hyperbolic or near-hyperbolic curve will produce a diverging light beam. Whether a light beam converges, diverges or is parallel is typically referred to as the angle of the beam.

In contrast, the angle of a light beam produced by a reflector constructed according to the present invention is determined not only by the shape of generator curve used, as described above, but also by the angle that the axis of rotation 904 makes with the optical axis 304. Regardless of the shape of generator curve used, the convergence of a beam may be increased by tipping the forward tip of a generator curve toward the optical axis. Similarly, as the forward tip of a generator curve is tipped farther away from the optical axis, a less convergent beam is produced. Thus, by selecting a shape for the generator curve and an angle that the axis of rotation makes with the optical axis, a designer may create a reflector according to the present invention that produces a light beam of a desired angle.

Figure 10:
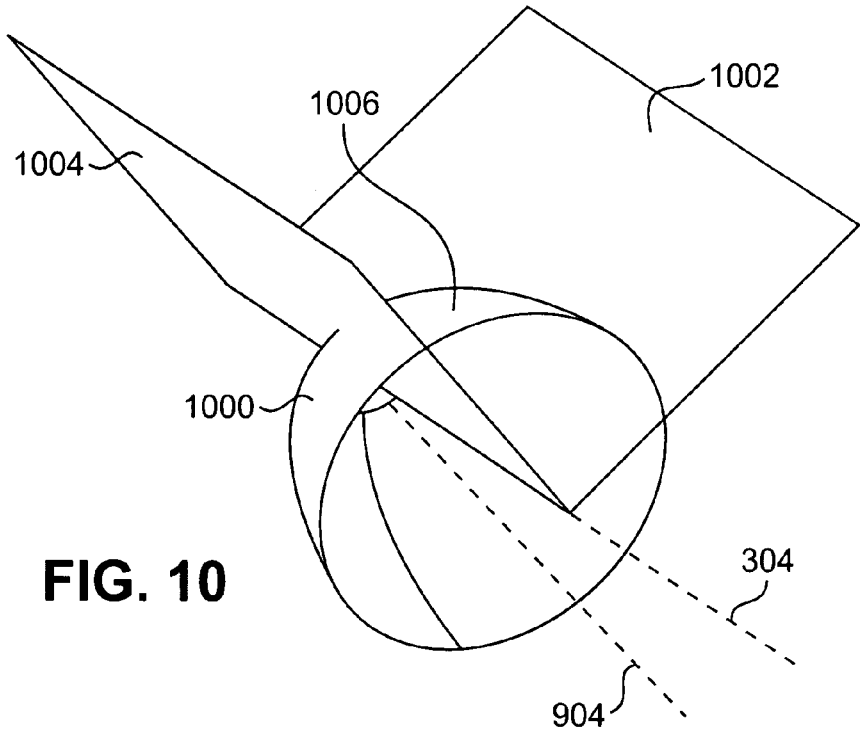
FIG. 10 is an orthogonal view of an exemplary reflector embodying the present invention.

FIG. 10 presents an orthogonal view of a smooth reflector 1000 generated by the method described with regard to FIG. 9. The reflector 1000 is not useful as generated, since it produces a beam that propagates in a direction coincident with axis 904, rather than a beam coincident with the optical axis 304. A reflecting zone 1006 may be defined by planes 1002 and 1004, which are oriented at 90 degrees to each other, and whose line of intersection coincides with the optical axis 304. A reflector according to the present invention may then be defined by duplicating reflecting zone 1006 at 90 degree increments about the optical axis 304.

Figure 11A:
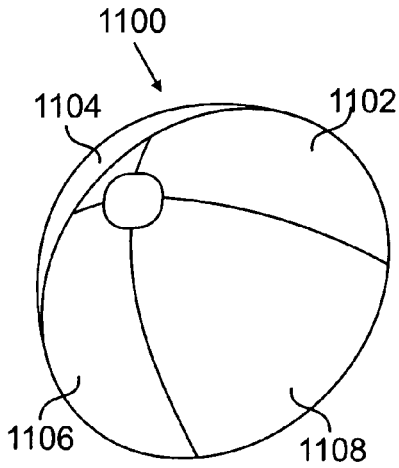
FIGS. 11A and 11B are orthogonal and front views, respectively, of a reflector according to the present invention.
Figure 11B:
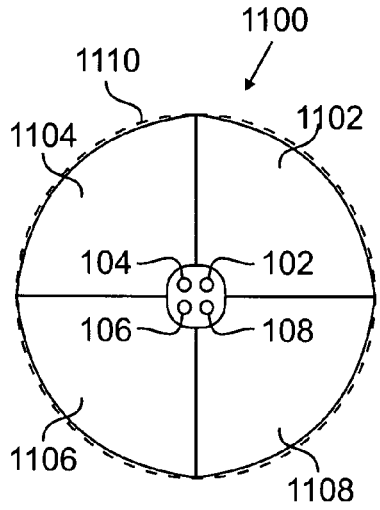

FIGS. 11A and 11B show four reflecting zones 1102, 1104, 1106 and 1108 joined together to form an exemplary reflector 1100 according to the present invention. The reflecting zones 1102, 1104, 1106 and 1108 are positioned and oriented so that they are rotationally aligned with the four filaments 102, 104, 106 and 108 in an HPL lamp. A cross section taken through the reflecting surface, perpendicular to the lamp's central longitudinal axis, is not circular. For clarity, a circle 1110 is superimposed on the reflector's perimeter to illustrate the deviation of the exemplary reflector's cross section from a circle.

Figure 12:
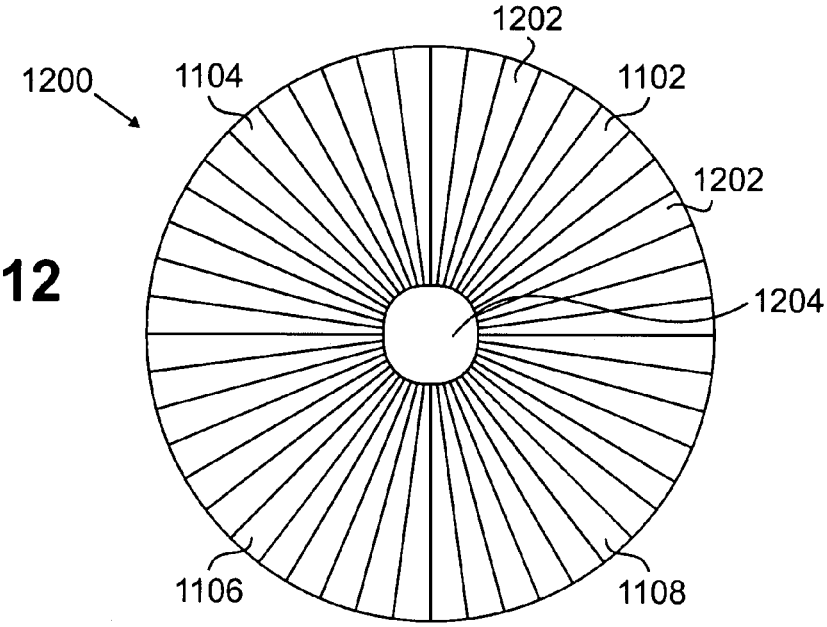
FIG. 12 is a schematic front view of an exemplary reflector embodying the present invention, formed with lunes on its surface.

FIG. 12 shows a preferred embodiment of the present invention. Reflector 1200 includes four reflecting zones 1102, 1104, 1106 and 1108, each of which has been fitted with 12 lunes 1202 for a total of 48 lunes on surface of reflector 1200. Due to the construction technique employed to generate the reflecting zones, the embodiment shown in FIG. 12 has a noncircular lamp access hole 1204. However, for convenience of manufacture, the lamp access hole 1204 can be made slightly oversized and round.

Figure 13:
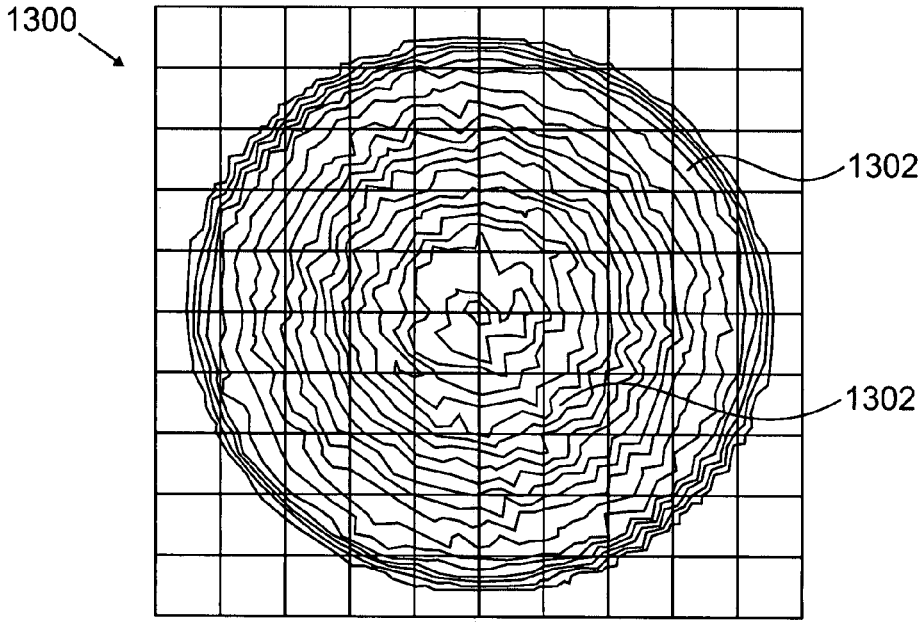
FIG. 13 illustrates an irradiance distribution chart for an Ellipsoidal Reflector Spotlight system employing a reflector according to the present invention.

The four reflecting zones in the exemplary reflectors shown in FIGS. 11 and 12 aim the light from their associated HPL lamp filament toward the optical axis. The superposition of flux from each combination of emitter and reflecting zone produces a beam with a circularly symmetric irradiance distribution, as shown in FIG. 13. In this plot, the isoirradiance curves 1302 are generally circular. Furthermore, the four-fold symmetry of the HPL lamp emitters is no longer visible in the projected beam.

The embodiment of the present invention described in this disclosure is a reflector for use with an HPL lamp having four linear, helically-wound incandescent filaments. However, it will be apparent to one of ordinary skill in the art that a reflector according to the present invention may be employed with lamps having other numbers of linear light emitting elements which are parallel to each other and are also parallel to the lamp's central longitudinal axis. For example, such lamps could be have two, three, five, eight, or any other number of elements.

Furthermore, the linear light emitting elements need not be comprised of helically-wound incandescent filaments. The elements may be multiple HID arc lamps, mounted parallel to each other and equally spaced around a central longitudinal axis. A single HID arc lamp, comprised of multiple light emitting volumes, each enclosed in a common burner and equally spaced about a central longitudinal axis, may also be employed. The linear light emitting elements may also be a parallel arrangement of optical fibers, whose surfaces have been scored to allow light to escape along their length. Alternatively, the elements may be a plurality of fluorescent tubes, either separate lamps or a single lamp with a number of parallel tubes arranged about a central longitudinal axis. One skilled in the art will recognize that other light sources having multiple linear light emitting elements may also be used with a reflector according to the present invention.

The above disclosure describes embodiments of the present invention for use in an ellipsoidal reflector spotlight (ERS) and a parabolic wash light (PAR). However, one skilled in the art will recognize that a reflector according to the present invention may be employed to collect and redistribute light from a plurality of parallel linear light sources in optical systems in a number of other applications, as well. For example, such optical systems might include cinema projection systems, theatrical follow-spotlight systems, digital projection systems employing digital micro-mirrors, digital projection systems employing reflective or refractive liquid crystal displays, rear projection televisions, fiber optic illuminators, and head up display illuminators.

Finally, the preferred embodiment depicted in FIG. 12 is a reflector whose surface is covered with 48 lunes. Other faceting or luning strategies may also be employed. A reflector according to the present invention may be covered with several courses of lunes, and the size and number of the lunes in each course may be varied over the reflecting surface. Additionally, a first portion of the reflecting surface may be luned, while a second portion of the reflecting surface may be faceted.

What is claimed is:

1. An illumination system for producing a light beam, comprising:

a lamp comprising a plurality of linear light emitting elements arranged with their longitudinal axes substantially parallel to each other, wherein the linear light emitting elements are positioned at different angles around a longitudinal axis of the lamp; and a concave reflector aligned with the longitudinal axis of the lamp, comprising a plurality of reflecting zones, which are equal in number to and rotationally aligned with the plurality of linear light emitting elements in the lamp, wherein at least one of the reflecting zones reflects light from at least two of the linear light emitting elements that are positioned at different angles around the longitudinal axis of the lamp, and wherein the light beam has a substantially circularly symmetric irradiance distribution.

2. The illumination system of claim 1, wherein the light beam produced by the lamp and concave reflector converges, further comprising:

a gate having an aperture aligned with the longitudinal axis of the lamp positioned substantially at the convergence of the light beam; and a lens aligned with the longitudinal axis of the lamp and positioned on the side of the gate opposite the incandescent lamp, wherein the lens has a focus located near the gate and produces an image of the gate at a plane located on the side of the lens opposite the gate.

3. The illumination system of claim 1, wherein the light beam produced by the lamp and concave reflector comprises substantially parallel light rays.

4. The illumination system of claim 1, wherein the light beam produced by the lamp and concave reflector diverges.

5. The illumination system of claim 1, wherein the concave reflector further comprises lunes.

6. The illumination system of claim 1, wherein the plurality of light emitting elements numbers four and the light emitting elements are helically wound incandescent filaments.

7. A concave reflector for use with a lamp comprising a plurality of linear light emitting elements arranged with their longitudinal axes substantially parallel to each other, wherein the linear light emitting elements are positioned at different angles around a longitudinal axis of the lamp, the concave reflector comprising:

a plurality of reflecting zones equal in number to the plurality of linear light emitting elements contained in the lamp, wherein when the concave reflector is aligned with the longitudinal axis of the lamp and the reflecting zones of the concave reflector are rotationally aligned with the plurality of linear light emitting elements, at least one reflecting zone reflects light from at least two linear light emitting elements that are positioned at different angles around the longitudinal axis of the lamp, and the concave reflector produces a beam of light having a substantially circularly symmetric irradiance distribution.

8. The concave reflector of claim 7, wherein the light beam produced by the concave reflector converges.

9. The concave reflector of claim 7, wherein the light beam produced by the concave reflector comprises substantially parallel light rays.

10. The concave reflector of claim 7, wherein the light beam produced by the concave reflector diverges.

11. The concave reflector of claim 7, wherein the concave reflector further comprises one of lunes and facets.

12. The concave reflector of claim 7, wherein a surface of one of the plurality of reflecting zones is defined by a generator curve rotated around an axis of rotation that is not coaxial with the longitudinal axis of the lamp.

13. The concave reflector of claim 12, wherein the generator curve is defined by an arbitrary curve.

14. The concave reflector of claim 12, wherein a shape of the generator curve is defined by a mathematical function.

15. A method for producing a beam of light from a lamp comprised of a plurality of linear light emitting elements arranged with their longitudinal axes substantially parallel with each other, wherein the linear light emitting elements are positioned at different angles around a central longitudinal axis of the lamp, comprising the steps of:

forming a concave reflector comprising a plurality of reflecting zones equal in number to the plurality of linear light emitting elements in the lamp; and installing the lamp coaxially in the concave reflector such that the reflecting zones are rotationally aligned with the plurality of linear light emitting elements in the lamp and at least one reflecting zone reflects light from at least two linear light emitting elements that are positioned at different angles around the longitudinal axis of the lamp, wherein the light beam has a substantially circularly symmetric irradiance distribution.

16. The method of claim 15, wherein the light beam produced by the lamp and concave reflector converges, further comprising the steps of:

positioning a gate having an aperture aligned with the longitudinal axis of the lamp substantially at the convergence of the light beam; and positioning a lens aligned with the longitudinal axis of the lamp on the side of the gate opposite the incandescent lamp, wherein the lens has a focus located near the gate and produces an image of the gate at a plane located on the side of the lens opposite the gate.

17. The method of claim 15, wherein the light beam produced by the lamp and concave reflector comprises substantially parallel light rays.

18. The method of claim 15, wherein the light beam produced by the lamp and concave reflector diverges.

19. The method of claim 15, wherein the step of forming the concave reflector comprises the step of forming a one of lunes and facets in the surface of the concave reflector.

20. The method of claim 15, wherein the step of forming the concave reflector comprises the step of defining a surface of a one of the plurality of reflecting zones by rotating a generator curve around an axis of rotation that is not coaxial with the longitudinal axis of the lamp.

* * * * *